US008919362B1

(12) United States Patent
Mortenson

(10) Patent No.: US 8,919,362 B1
(45) Date of Patent: Dec. 30, 2014

(54) WALKING CANE WITH PLATFORM

(71) Applicant: Billy Mortenson, Canby, MN (US)

(72) Inventor: Billy Mortenson, Canby, MN (US)

( * ) Notice: Subject to any disclaimer, the term of this patent is extended or adjusted under 35 U.S.C. 154(b) by 0 days.

(21) Appl. No.: 14/091,393

(22) Filed: Nov. 27, 2013

Related U.S. Application Data

(60) Provisional application No. 61/886,939, filed on Oct. 4, 2013.

(51) Int. Cl.
*A61H 3/00* (2006.01)
*A45B 3/00* (2006.01)
*A45B 9/04* (2006.01)

(52) U.S. Cl.
CPC .. *A45B 9/04* (2013.01); *A61H 3/00* (2013.01); *A45B 3/00* (2013.01)
USPC ..... 135/66; 135/75; 135/84; 482/76

(58) Field of Classification Search
CPC ..... A61H 3/02; A61H 3/00; A61H 2003/005; A45B 9/04; A45B 3/00; A45B 2009/002; A45B 2009/007
USPC ..... 135/65–66, 74–75, 77, 84; 482/75–76; 248/155, 155.5, 188.9, 178.1, 218.4, 248/219.3, 227.3; 294/1.4–1.5, 50.9, 181
See application file for complete search history.

(56) References Cited

U.S. PATENT DOCUMENTS 3,186,710 A * 6/1965 St Peter ..... 482/76
3,456,663 A * 7/1969 Blum ..... 135/66
3,738,674 A * 6/1973 Pauls ..... 280/816
4,274,430 A * 6/1981 Schaaf et al. ..... 135/65
4,299,246 A * 11/1981 Marsh ..... 135/66
4,884,587 A * 12/1989 Mungons ..... 135/65
5,385,163 A * 1/1995 Fairchild ..... 135/65
5,755,245 A 5/1998 Van Helvoort
6,044,507 A * 4/2000 Smith ..... 5/662
6,058,953 A 5/2000 Stefanelli
6,330,888 B1 * 12/2001 Aravantinos et al. ..... 135/66
6,378,540 B2 * 4/2002 Iwasa ..... 135/65
6,651,684 B2 11/2003 Spitzer
6,932,095 B1 8/2005 Hanson et al.
7,398,791 B2 * 7/2008 Tucker ..... 135/66
D632,069 S * 2/2011 Thiessens ..... D3/7

(Continued)

FOREIGN PATENT DOCUMENTS

JP 2002034717 A * 2/2002
JP 2006239378 A * 9/2006
WO WO 9406393 A2 * 3/1994
WO WO 2005112865 A1 * 12/2005

*Primary Examiner* — Winnie Yip
(74) *Attorney, Agent, or Firm* — Robert C. Montgomery; Montgomery Patent & Design

(57) ABSTRACT

A telescoping cane with folding platform has a telescoping mechanism to adjust the height. A bottom portion of the cane is pivotally attached to a platform. The platform pivots upward into a parallel position with a shaft of the cane for a stowed position. In a deployed position, the platform is pivoted to a perpendicular position. The wider base of the platform assists a user in balancing his stance when using the cane. The pivoting assembly is further provided with a locking mechanism to maintain the platform in a deployed or stowed position. The cane is also equipped with a platen to assist with placement of user's foot upon the platform, which aids in stabilizing the cane when attempting to rise from a seated position.

18 Claims, 5 Drawing Sheets

(56) References Cited

U.S. PATENT DOCUMENTS

| | | | | |
|---|---|---|---|---|
| 7,984,723 | B2 | 7/2011 | Seivert et al. | |
| 8,381,748 | B2 | 2/2013 | Martin | |
| 8,393,342 | B2 | 3/2013 | Goldberg et al. | |
| 2008/0041432 | A1 | 2/2008 | Willis | |
| 2009/0235966 | A1 * | 9/2009 | Birnbaum | 135/66 |

* cited by examiner

WALKING CANE WITH PLATFORM

RELATED APPLICATIONS

The present invention was first described in and claims the benefit of U.S. Provisional Application No. 61/886,939, filed Oct. 4, 2013, the entire disclosures of which are incorporated herein by reference.

FIELD OF THE INVENTION

The present invention relates generally to an adjustable cane with a folding platform pivotally attached to a bottom thereof.

BACKGROUND OF THE INVENTION

For those that suffer from afflictions such as arthritis or other degenerative diseases, even the most trivial daily activity can become difficult, and sometimes impossible. The use of a conventional walking cane by people that suffer from the aforementioned afflictions, as well as by those of advancing age, provides a stabilizing force, and a means by which they can move about safely and with lessened discomfort. While the use of a walking cane does allow the user to move about, there are numerous disadvantages associated with their use. Perhaps the most troublesome is that when the person is walking or standing and needs to use both hands to perform a function, there is not often a location where the cane can be stored in order to free up the hands. The user is forced to hook it over their arm, walk a distance to where they can store it, or perhaps lay it on the ground. None of these are satisfactory solutions as they are clumsy, and require extra effort, or require bending or stooping over to pick up the cane. Additionally, the single support point base of the cane makes it unstable, especially with off-center use such as when trying to rise from a sitting position to a standing one. Accordingly, there exists a need for a means by which a standard walking cane can be modified to address the deficiencies as described above. The development of the cane fulfills this need.

The apparatus is a cane system that enables the unattended self-standing support of the cane when not in use, and also provides for added assistance when using the cane to rise from a sitting position. The cane shaft telescopes for length adjustment. A platform, positioned at the bottom of the cane, folds out to form an approximate ninety degree (90° ) angle with the cane shaft. This platform can be folded in when it is desired to use the apparatus as a cane in a conventional manner. When folded out, the cane becomes self standing, which is beneficial when both hands are needed to perform functions, and no location is handy to temporarily place the cane. Additionally, the platform, when in a folded out position, imparts a stabilizing force to the upper part of the cane, making it stable when used in an off-center manner. Such usage is common when pushing on the cane when trying to stand up from a sitting position in a chair. A platen formed into the platform enables a user to place his foot on the platform for providing a supplementary stabilizing force when attempting to rise from a sitting position.

Prior art in this field consists of telescoping canes with kickstand style supports. While these supports may present a means to support the cane in a free-standing position, they fail to provide suitable stabilizing balance to assist a user in rising from a seated position. Furthermore, such supports fall short in enabling a user to employ his foot to further stabilize the cane. Other prior art canes are equipped with modified handles that support the cane in a free-standing position, but this requires placing the cane on the ground in an inverted position such that the cane's handle is rested upon the unsanitary ground. Other prior art canes are collapsible, or otherwise foldable, which provides a means to free up a user's hands, but these canes lack the added utility of supplemental stabilization provided by the platform of the current invention. Other prior art canes are equipped with tiltable handles, which may be exploited to provide added leverage for user's, but these again fail to provide suitable stabilizing balance to assist a user in rising from a seated position. Tilt-handle canes further lack the means to support the cane in a free-standing position.

It is an objective of this invention to provide a cane having a platform affixed to a bottom portion thereof to enable free-standing of the cane in an up-right position, thereby freeing up a user's hands.

It is a further objective of this invention to enable the platform to provide stability for a user employing the cane, especially when attempting to rise from a seated position.

It is a further objective of this invention to provide a platen formed into the platform to enable a user to employ his foot by placing it on the platform and supply supplementary stabilizing balance, especially when attempting to rise from a seated position.

It is a further objective of this invention to enable pivoting motion of the platform to deploy and retract the platform at a user's discretion.

It is a further objective of this invention to enable locking the platform in a deployed or retracted position.

It is a further objective of this invention to provide a length adjustment means to the cane so as to enable a user to exploit proper and adequate leverage from the cane based upon a user's stature.

An added benefit of this invention is to provide fingered reliefs in the handle portion for added dexterity and comfort.

An additional benefit of this invention is to provide a slip resistant feature to a bottom of the cane to assist with steadiness while the cane is in use.

SUMMARY OF THE INVENTION

The apparatus comprises a telescoping shaft assembly, a hand grip having a plurality of formed finger reliefs, and a platform assembly. The telescoping shaft assembly comprises a first shaft that slidably inserts into another shaft, where the adjustment of the length of the shaft assembly occurs by the first shaft traversing the length of the second shaft. One (1) shaft is provided with a spring-loaded lock button that engages correspondingly aligned apertures of the other shaft to lock the shafts in relative positions to each other. A top portion of the shaft assembly is provided with the hand grip.

The platform assembly is pivotally attached to a bottom portion of the shaft assembly, and comprises a platform that pivots from an up position to a down position. The up position corresponds to the platform being substantially parallel to the shaft assembly, and the down position corresponds to the platform being substantially perpendicular to the shaft assembly. The platform can be locked in the up or down position. While in the down position, the shaft assembly and platform assembly form a general "L"-shape, where the platform provides a base for added stability. The platform also enables the apparatus to stand freely. In addition, the platform may be used to place a user's foot upon to assist with steadying the apparatus while attempting to rise from a seated position. A platen is formed into the platform to better aid with placement of a user's foot upon the platform. While in an up position, the apparatus can be utilized as a cane in a conventional manner. A bottom portion of the cane is further provided with a high-friction tip such that when it is in the up position, the tip makes contact with the floor.

Furthermore, the described features and advantages of the disclosure may be combined in various manners and embodiments as one skilled in the relevant art will recognize. The disclosure can be practiced without one (1) or more of the features and advantages described in a particular embodiment.

Further advantages of the present disclosure will become apparent from a consideration of the drawings and ensuing description.

BRIEF DESCRIPTION OF THE DRAWINGS

The advantages and features of the present disclosure will become better understood with reference to the following more detailed description and claims taken in conjunction with the accompanying drawings, in which like elements are identified with like symbols, and in which:

DESCRIPTIVE KEY

Figure 1:
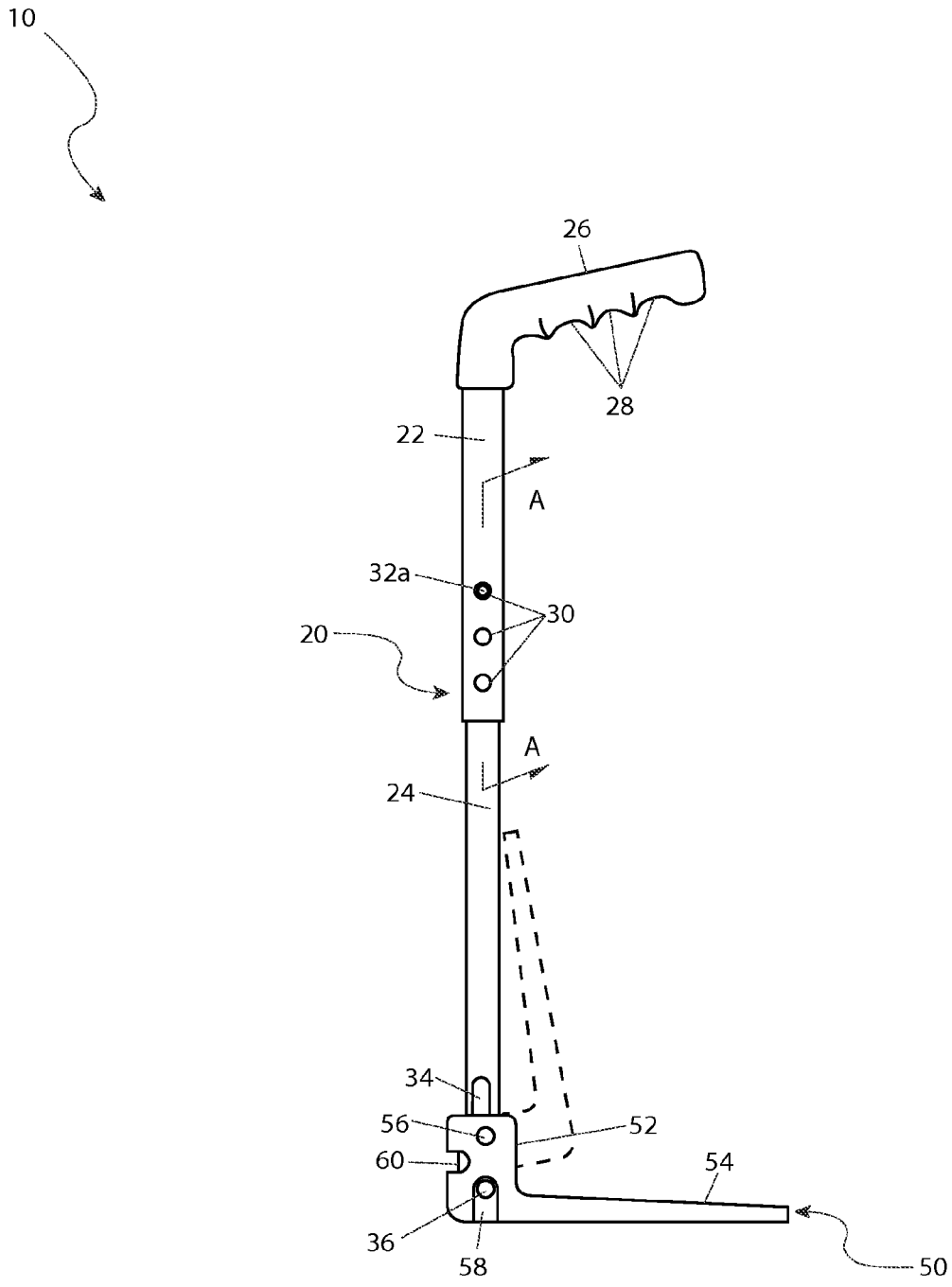
FIG. 1 is a perspective view of a walking cane with integral platform 10, according to a preferred embodiment of the present invention.

10 walking cane with integral platform
20 shaft assembly
22 upper shaft section
24 lower shaft section
26 grip
28 finger relief
30 first aperture
32*a* locking button
32*b* spring
32*c* fastener
34 first slot
36 first pin
38 tip
50 platform assembly
52 collar
53 center opening
54 platen
56 second pin
58 second slot
60 third slot
62 second aperture
100 user
105 hand
110 foot
115 floor surface
120 chair

DETAILED DESCRIPTION OF THE PREFERRED EMBODIMENT

The best mode for carrying out the invention is presented in terms of its preferred embodiment, herein depicted within FIGS. 1 through 5. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a walking cane with integral platform (herein described as the "apparatus") 10, having a deployable platform assembly 50 affixed to a bottom portion to aid a user 100 while rising from a sitting position upon a furniture item such as a chair 120, as well as provide a self standing function.

Figure 2:
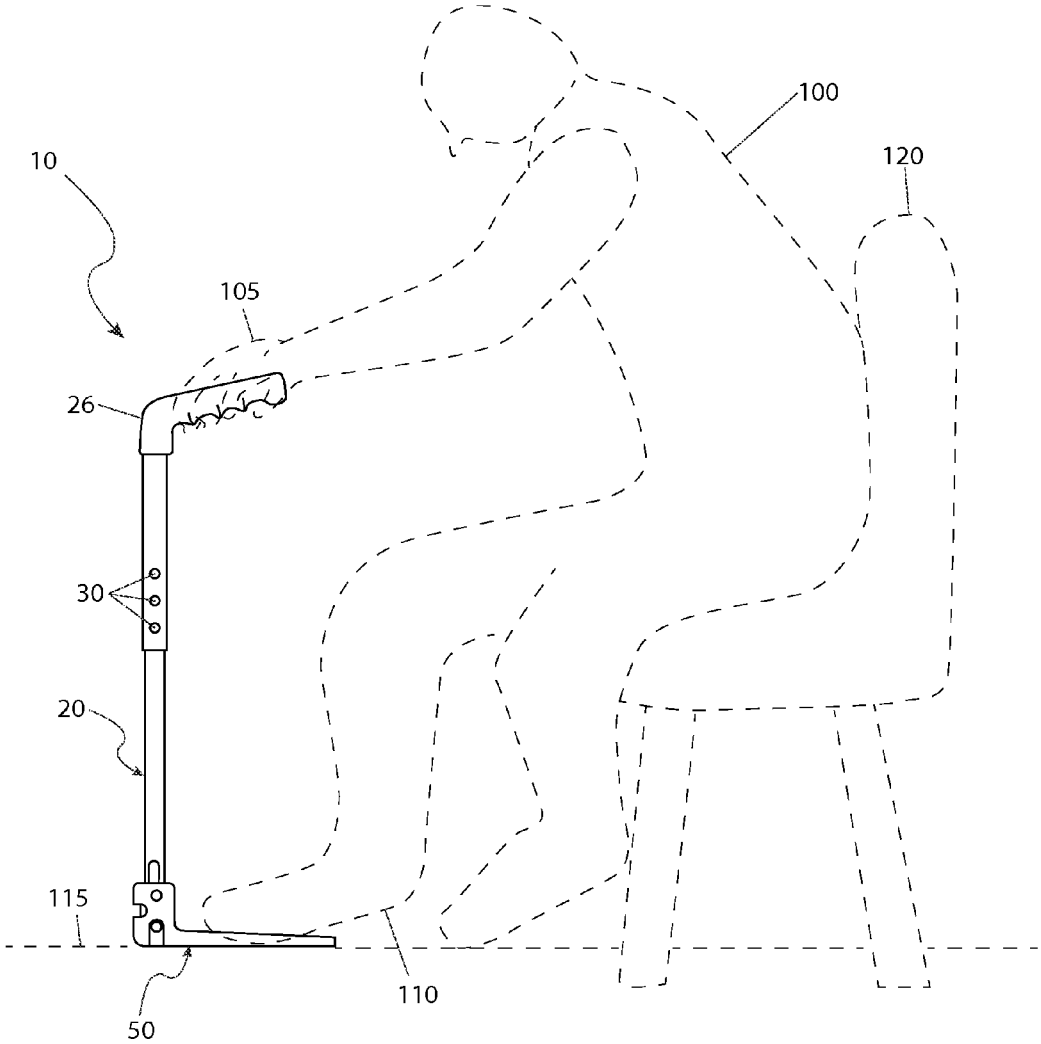
FIG. 2 is an environmental view of the walking cane with integral platform 10 depicting an in-use state, according to a preferred embodiment of the present invention.

Referring now to FIGS. 1 and 2, a perspective and environmental views of the apparatus 10, according to a preferred embodiment of the present invention, are disclosed. The apparatus 10 comprises a length-adjustable shaft assembly 20, a hand grip 26 having a plurality of formed finger reliefs 28, and a platform assembly 50. The shaft assembly 20 is preferably made an aluminum tube material or other lightweight material. The shaft assembly 20 further comprises an upper shaft section 22 and a lower shaft section 24 being adjustably joined together in a telescoping manner via a plurality of first apertures 30 and a spring-loaded locking button 32*a*. In use, a user 100 selectively obtains a desired length of the shaft assembly 20 by aligning and engaging the locking button 32*a* within a particular first aperture 30.

The shaft assembly 20 is affixed along a top end portion to an "L"-shaped hand grip 26. The hand grip 26 preferably comprises a rubber-coated plastic or metal core preferably affixed to the upper shaft 22 being integrally-molded onto said shaft assembly 20 or otherwise equivalently affixed using adhesives, fasteners, or the like.

The shaft assembly 20 also provides pivoting attachment to a platform assembly 50 at a bottom end portion. The platform assembly 50 is to be capable of pivoting downwardly and being locked in a horizontal position allowing a user 100 to step upon the platform assembly 50 with one (1) foot 110 to provide stability to the shaft assembly portion 20 while using the apparatus 10 to stand up from a sitting position in a chair 120. The platform assembly 50 may also be secured in an upward vertical stowed position (see FIG. 4*b*), allowing the apparatus 10 to be utilized for walking in an aided manner (see FIGS. 3 and 4*a*). The lower shaft section 24 further comprises a cylindrical rubber or soft plastic tip 38 partially inserted, and slightly protruding from a bottom open end portion, to provide high-friction contact with a floor surface 115 while utilizing the apparatus 10 during aided walking.

Figure 3:
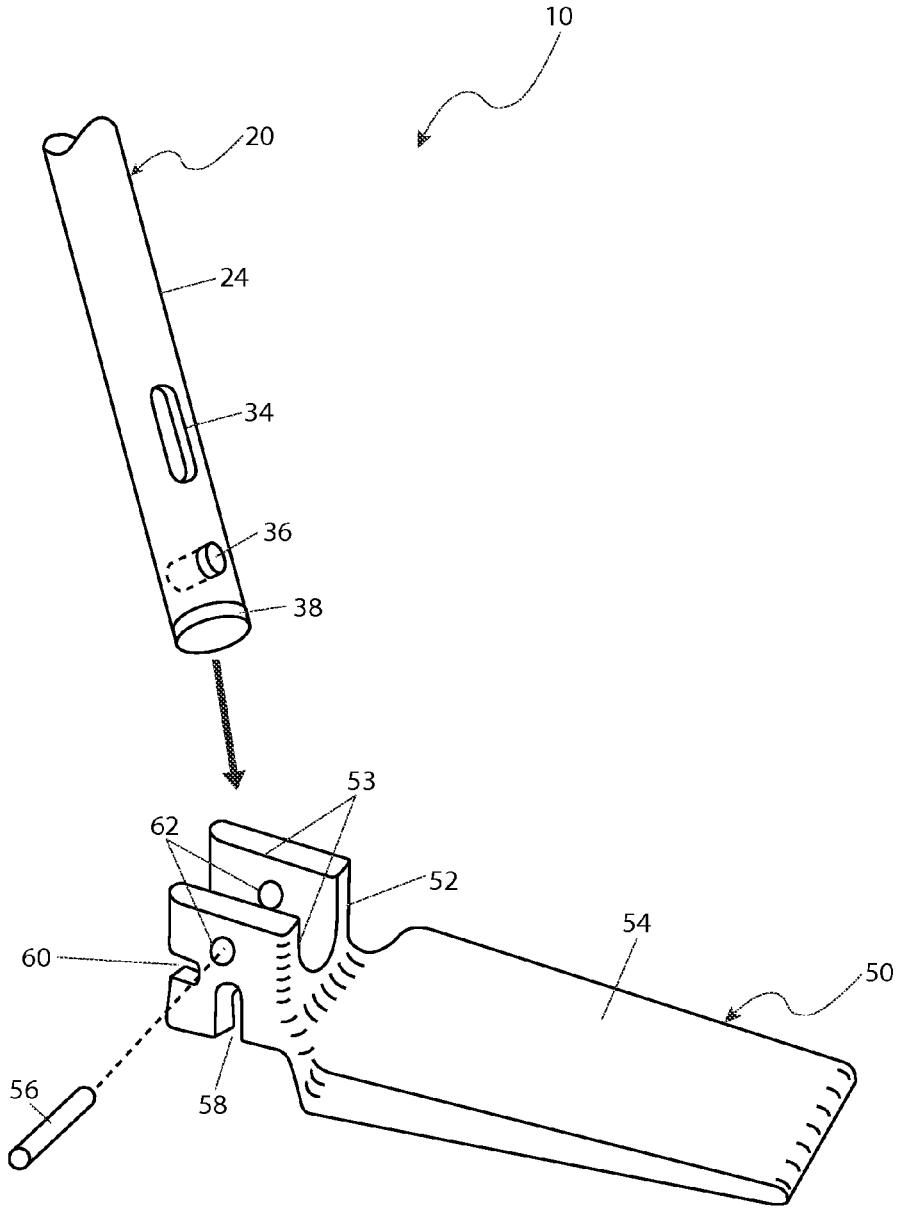
FIG. 3 is an exploded view of a platform assembly portion 50 of the walking cane with integral platform 10, according to a preferred embodiment of the present invention.

Referring now to FIG. 3, an exploded view of a platform assembly portion 50 of the apparatus 10, according to a preferred embodiment of the present invention, is disclosed. The shaft assembly 20 provides pivoting attachment to the platform assembly 50 at a bottom end portion via integral first slot 34 and first pin 36 portions. The platform assembly 50 comprises a collar 52 comprises a "U"-shaped center opening 53 being shaped so as to rotatingly receive the lower shaft section 24 within. The collar 52 also includes features which enable engagement and rotational attachment to the first slot 34 and first pin 36 portions of the shaft assembly 20 including a second pin 56, a second slot 58, a third slot 60, and a pair of second apertures 62.

The platform assembly 50 further comprises an integral and forwardly extending flat platen portion 54 being approximately four inches (4 in.) in width and six inches (6 in.) in length. The platen 54 is envisioned being made using a metal or plastic material and provides a suitable surface onto which a user 100 may place their foot 110, thereby stabilizing the apparatus 10 for use while standing up from a sitting position. The lower shaft section 24 is attached to the collar portion 53 via press-fit of the second pin 56 through opposing second apertures 62 of the collar 52, and coincidental insertion through the first slot portion 34 of the lower shaft section 24. The first slot 34 allows the second pin 56 to move freely in a vertical direction, allowing the platform assembly 50 to pivot and to be secured at either vertical or horizontal positions via engagement of the first pin 36 within respective first slot 60 and second slot 58 portions (see FIGS. 4*a* and 4*b*).

Figure 4B:
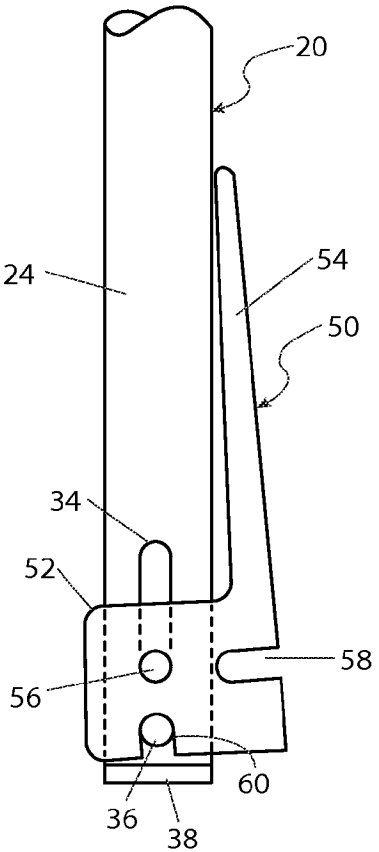
FIG. 4*b* is another close-up view of the platform assembly 50 depicting a stowed state, according to a preferred embodiment of the present invention; and, FIG. 5 is a sectional view of a shaft assembly portion 20 of the walking cane with integral platform 10 taken along section line A-A (see FIG. 1), according to a preferred embodiment of the present invention.
Figure 4A:
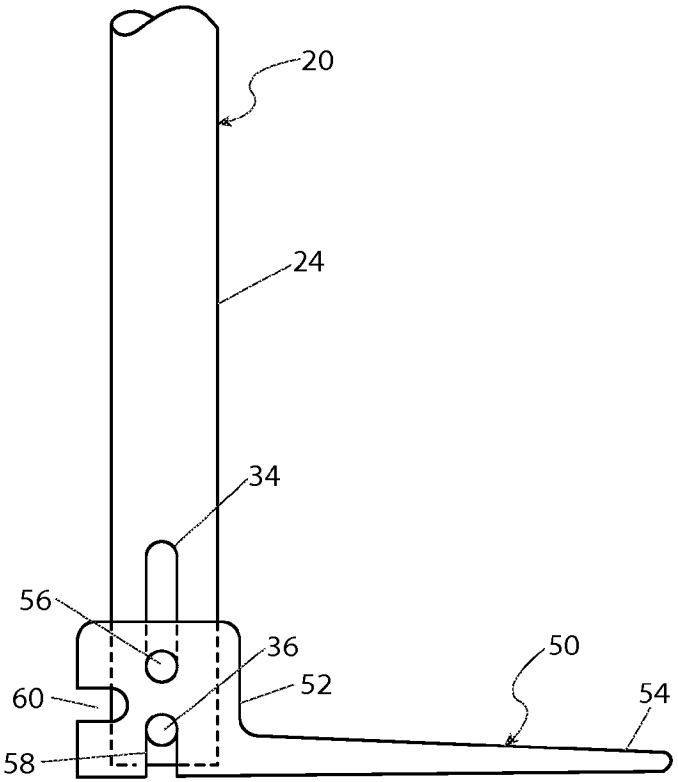
FIG. 4*a* is a close-up view of the platform assembly 50 depicting a deployed state, according to a preferred embodiment of the present invention.

Referring now to FIGS. 4*a* and 4*b*, close-up views of the platform assembly 50 depicting deployed and stowed states, according to a preferred embodiment of the present invention, are disclosed. The selectable positioning of the platform assembly 50 allows rotation to a ninety (90° ) degree angle from the bottom of the lower shaft section 24 via rotation of the second pin 56 within the first slot 34, and subsequent lowering of the platform assembly 50 downwardly such that the first pin 36 engages the second slot 58. The platform assembly 50 may also be positioned and secured in a vertical stowed position by lifting the platform assembly 50 upwardly, and rotating said platform assembly 50 upward about the second pin 56 until generally vertical. The platform assembly 50 is then lowered such that the first pin 36 engages the third slot 60.

Figure 5:
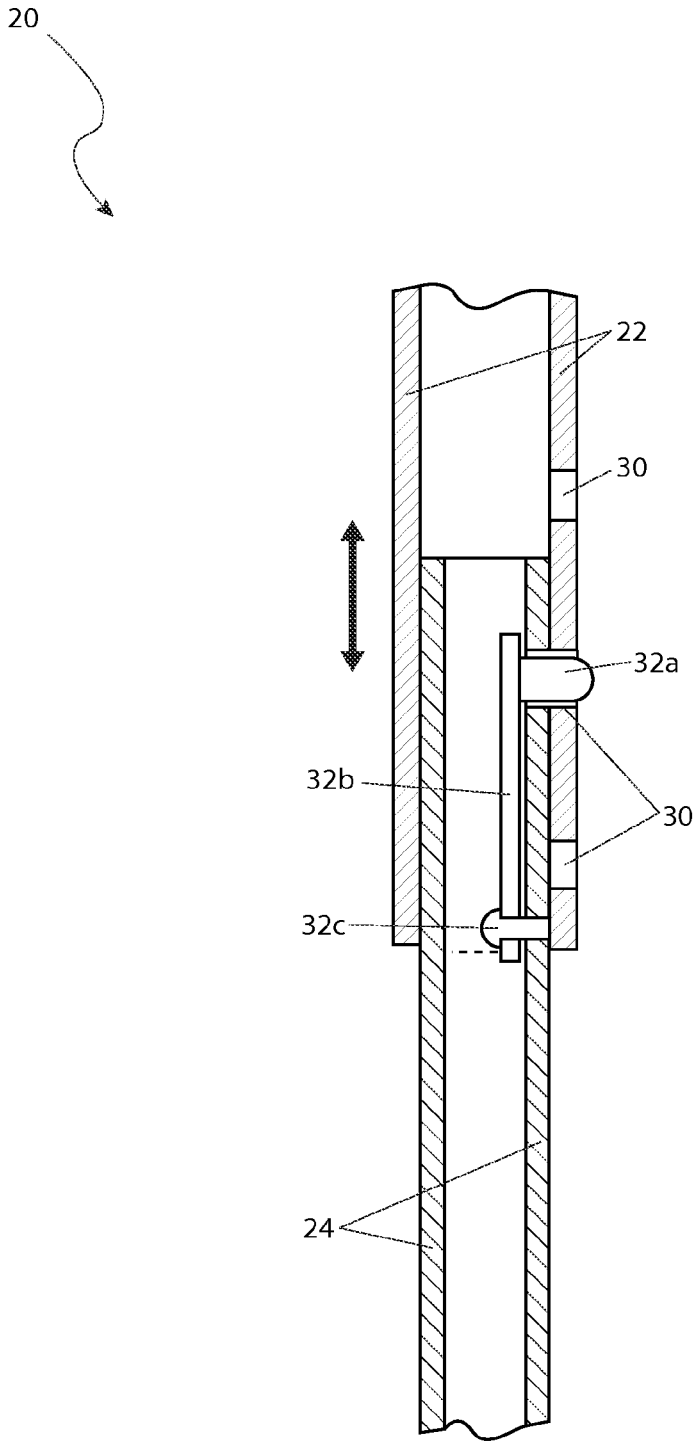

Referring now to FIG. 5, a sectional view of the shaft assembly 20 taken along section line A-A (see FIG. 1), according to a preferred embodiment of the present invention, is disclosed. The upper shaft section 22 and lower shaft section 24 portions are adjustably joined together in a telescoping manner and secured at a particular combined length via a plurality of first apertures 30 and a locking button 32*a*. The equally-spaced first apertures 30 are arranged in a vertical row along a side surface of the upper shaft section 22, and the corresponding spring-loaded locking button 32*a* is located within the lower shaft section 24. The spring-loaded locking button 32*a* is biased outwardly by an integral elongated leaf spring portion 32*b* within the lower shaft section 24, being anchored to said lower shaft section 24 by a fastener 32*c* such as a rivet.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the apparatus 10, it would be utilized as indicated in FIG. 2.

The method of configuring and utilizing the apparatus 10 for aided walking may be achieved by performing the following steps: procuring the apparatus 10; adjusting a length of the shaft assembly 20 by pressing inwardly upon the locking button 32*a*; sliding the shaft sections 22, 24 relative to each other until obtaining a desired overall length of said shaft assembly 20; securing the shaft assembly 20 at the desired length by allowing the locking button 32*a* to protrude through an aligned first aperture 30; utilizing the apparatus 10 as a normal walking cane by folding the platform assembly 50 upwardly into the stowed position against the shaft assembly 20 by lifting said platform assembly 50 above the first pin 36; rotating the platform assembly 50 upwardly to a generally vertical position; securing the platform assembly 50 by lowering the platform assembly 50 downward so as to engage the third slot 60 and first pin 36 portions; using the user's hand 105 to grasp the grip portion 26 using the finger reliefs 28; and, utilizing the features of the apparatus 10 to aid a user 100 to walk to a destination.

The method of configuring and utilizing the platform assembly portion 50 of the apparatus 10 may be achieved by performing the following additional steps: lifting the platform assembly 50 above the first pin 36; rotating the platform assembly 50 downwardly until at a horizontal orientation; lower the platform assembly 50 so as to engage the second slot 58 and first pin 36 portions; stepping upon the platen portion 54 of the platform assembly 50 with one (1) foot 110 to provide stability to the shaft assembly portion 20; using a hand 105 to grasp the hand grip 20 to aid a user 100 while standing up from a sitting position in a chair 120; and, benefiting for more secure and safer means to ascend from a sitting position afforded a user 100 of the present invention 10.

The deployed platform assembly 50 may also act as a stabilizing base allowing the apparatus 10 to be left unattended in a "stand-alone" manner for a period of time to free up both hands of a user 100 when needed.

The foregoing descriptions of specific embodiments have been presented for purposes of illustration and description. They are not intended to be exhaustive or to limit to the precise forms disclosed and many modifications and variations are possible in light of the above teachings. The embodiments were chosen and described in order to best explain principles and practical application to enable others skilled in the art to best utilize the various embodiments with various modifications as are suited to the particular use contemplated.

What is claimed is:

1. A cane, comprising:

a tubular shaft, having a top end and a bottom end, comprising:

a vertically arranged elongated slot in said tubular shaft located adjacent to said bottom end; and, a shaft pin protruding from at least one side surface of said tubular shaft located at an intermediate position between said elongated slot and said bottom end;

a hand grip disposed on said top end;

a fastening means to affix said hand grip to said top end;

a platform, comprising:

a planar member;

a collar located at a top rear end of said planar member, having a general U shaped opening;

a first aperture within a first side of said collar;

a second aperture within a second side of said collar;

a first collar slot within a bottom of said first side;

a second collar slot within a bottom of said second side;

a third collar slot within a rear of said first side;

a fourth collar slot within a rear of said second side;

a pivot pin adapted to insert through said first and second apertures and said elongated slot of said tubular shaft after said bottom end is received by said U shaped opening; and, a tip disposed at a distal portion of said bottom end;

wherein said shaft pin engages said first and second slots to retain said platform in a substantially ninety degree angle with respect to said shaft;

wherein said elongated slot enables positioning of said platform relative to said tubular shaft to enable disengagement of said shaft pin from said first and second slots;

wherein said U-shaped opening provides clearance for rotational motion of said bottom end about said pivot pin to allow said platform to be rotated from said substantially ninety degree angle;

wherein said elongated slot enables positioning of said platform relative to said tubular shaft to enable engagement of said shaft pin with said third and fourth slots; and, wherein said shaft pin engages said third and fourth slots to retain said platform in a substantially parallel position with respect to said shaft.

2. A cane, comprising:

a tubular shaft assembly, comprising:

an upper section, having a top end and a receiving end, comprising a plurality of vertically arranged shaft apertures located adjacent to said receiving end;

a lower section, having an insertion end and a bottom end, comprising a pin lock aperture located adjacent to said insertion end;

a leaf spring fastened to an inner portion of said lower section and situated beneath said pin lock aperture;

a pin lock extending through said pin lock aperture and placed into mechanical connection with said leaf spring so as to bias said pin lock in a protruding position;

a vertically arranged elongated slot in said tubular shaft located adjacent to said bottom end;

a shaft pin protruding from at least one side surface of said tubular shaft located at an intermediate position between said elongated slot and said bottom end; and, wherein said insertion end is configured to insert into said receiving end;

wherein said insertion end inserts into said receiving end and traverses an interior space of said upper section until said pin lock engages a shaft aperture of said upper section; and, wherein further adjustment of said shaft assembly length is achieved by depressing said pin lock to disengage it from an individual shaft aperture and to enable said lower section to traverse said interior space until another individual shaft aperture is engaged with said pin lock;

a hand grip disposed on said top end;

a fastening means to affix said hand grip to said top end;

a platform, comprising:

a planar member;

a collar located at a top rear end of said planar member, having a general U shaped opening;

a first aperture within a first side of said collar;

a second aperture within a second side of said collar;

a first collar slot within a bottom of said first side;

a second collar slot within a bottom of said second side;

a third collar slot within a rear of said first side;

a fourth collar slot within a rear of said second side;

a pivot pin adapted to insert through said first and second apertures and said elongated slot of said tubular shaft after said bottom end is received by said U shaped opening; and, a tip disposed at a distal portion of said bottom end;

wherein said shaft pin engages said first and second slots to retain said platform in a substantially ninety degree angle with respect to said shaft;

wherein said elongated slot enables positioning of said platform relative to said tubular shaft to enable disengagement of said shaft pin from said first and second slots;

wherein said U-shaped opening provides clearance for rotational motion of said bottom end about said pivot pin to allow said platform to be rotated from said substantially ninety degree angle;

wherein said elongated slot enables positioning of said platform relative to said tubular shaft to enable engagement of said shaft pin with said third and fourth slots; and, wherein said shaft pin engages said third and fourth slots to retain said platform in a substantially parallel position with respect to said shaft.

3. The cane recited in claim 2, wherein said shaft apertures are equally spaced from each other.

4. The cane recited in claim 2, wherein said shaft assembly is aluminum.

5. The cane recited in claim 2, wherein said hand grip is generally L shaped.

6. The cane recited in claim 2, wherein said hand grip is plastic.

7. The cane recited in claim 2, wherein said hand grip is coated with rubber.

8. The cane recited in claim 2, wherein said hand grip is provided with a plurality of finger reliefs.

9. The cane recited in claim 2, wherein said fastening means permanently affixes said hand grip to said top end.

10. The cane recited in claim 2, wherein said fastening means removably affixes said hand grip to said top end.

11. The cane recited in claim 2, wherein said tip exhibits a high coefficient of friction with an average floor surface.

12. The cane recited in claim 2, wherein said tip is rubber.

13. The cane recited in claim 2, wherein said tip is cylindrical.

14. The cane recited in claim 2, wherein said platform is attached to said shaft assembly such that said platform and said handle grip protrude from a same side of said shaft assembly when platform is pivoted to said substantially ninety degree angle.

15. A cane, comprising:

an aluminum tubular shaft assembly, comprising:

an upper section, having a top end and a receiving end, comprising a plurality of vertically arranged equidistant shaft apertures located adjacent to said receiving end;

a lower section, having an insertion end and a bottom end, comprising a pin lock aperture located adjacent to said insertion end;

a leaf spring fastened to an inner portion of said lower section and situated beneath said pin lock aperture;

a pin lock extending through said pin lock aperture and placed into mechanical connection with said leaf spring so as to bias said pin lock in a protruding position;

a vertically arranged elongated slot in said tubular shaft located adjacent to said bottom end;

a shaft pin protruding from at least one side surface of said tubular shaft located at an intermediate position between said elongated slot and said bottom end; and, wherein said insertion end is configured to insert into said receiving end;

wherein said insertion end inserts into said receiving end and traverses an interior space of said upper section until said pin lock engages a shaft aperture of said upper section; and, wherein further adjustment of said shaft assembly length is achieved by depressing said pin lock to disengage it from an individual shaft aperture and to enable said lower section to traverse said interior space until another individual shaft aperture is engaged with said pin lock;

a generally L shaped, plastic, hand grip disposed on said top end, wherein a plurality of finger reliefs are formed into said hand grip;

a rubber coating covering said hand grip;

a fastening means to affix said hand grip to said top end;

a platform, comprising:

a planar member, wherein a platen is formed into a top surface thereof;

a collar located at a top rear end of said planar member, having a general U shaped opening;

a first aperture within a first side of said collar;

a second aperture within a second side of said collar;

a first collar slot within a bottom of said first side;

a second collar slot within a bottom of said second side;

a third collar slot within a rear of said first side;

a fourth collar slot within a rear of said second side;

a pivot pin adapted to insert through said first and second apertures and said elongated slot of said tubular shaft after said bottom end is received by said U shaped opening; and, a tip disposed at a distal portion of said bottom end, wherein said tip is a cylindrical rubber member;

wherein said shaft pin engages said first and second slots to retain said platform in a substantially ninety degree angle with respect to said shaft;

wherein said platen enables a user to place a foot upon the platform and provide supplemental stabilizing balance to said cane;

wherein said elongated slot enables positioning of said platform relative to said tubular shaft to enable disengagement of said shaft pin from said first and second slots;

wherein said U-shaped opening provides clearance for rotational motion of said bottom end about said pivot pin to allow said platform to be rotated from said substantially ninety degree angle;

wherein said elongated slot enables positioning of said platform relative to said tubular shaft to enable engagement of said shaft pin with said third and fourth slots; and, wherein said shaft pin engages said third and fourth slots to retain said platform in a substantially parallel position with respect to said shaft.

16. The cane recited in claim 15, wherein said fastening means permanently affixes said hand grip to said top end.

17. The cane recited in claim 15, wherein said fastening means removably affixes said hand grip to said top end.

18. The cane recited in claim 15, wherein said platform is attached to said shaft assembly, such that said platform and said handle grip protrude from a same side of said shaft assembly when platform is pivoted to said substantially ninety degree angle.

* * * * *